United States Patent [19]

Henville

[11] 4,345,125

[45] Aug. 17, 1982

[54] SNAP ACTION SWITCHES

[75] Inventor: Michael I. Henville, Maidenhead, England

[73] Assignee: Unimax Switch Limited, Maidenhead, England

[21] Appl. No.: 182,223

[22] Filed: Aug. 28, 1980

[30] Foreign Application Priority Data

Aug. 31, 1979 [GB] United Kingdom ..... 7930346

[51] Int. Cl.[3] ..... H01H 13/38

[52] U.S. Cl. ..... 200/67 D

[58] Field of Search ..... 200/67 R, 67 A, 67 B, 200/67 C, 67 D, 67 DA, 67 DB, 67 E, 67 PK, 159 R; 74/100 P

[56] References Cited

U.S. PATENT DOCUMENTS 2,318,734 5/1943 Baak ..... 200/67 D 3,539,742 11/1970 Wilkes ..... 200/67 DA

*Primary Examiner*—Stephen Marcus

*Attorney, Agent, or Firm*—Bernard Malina

[57] ABSTRACT

A snap-action micro-switch of a known general kind has an auxiliary spring that acts on the actuating member in the operating direction but has a force characteristic that falls with displacemet away from the rest position. The effect of this is to reduce the required externally applied actuating force but without reducing the contact pressure applied by the normal snap-action spring.

2 Claims, 1 Drawing Figure

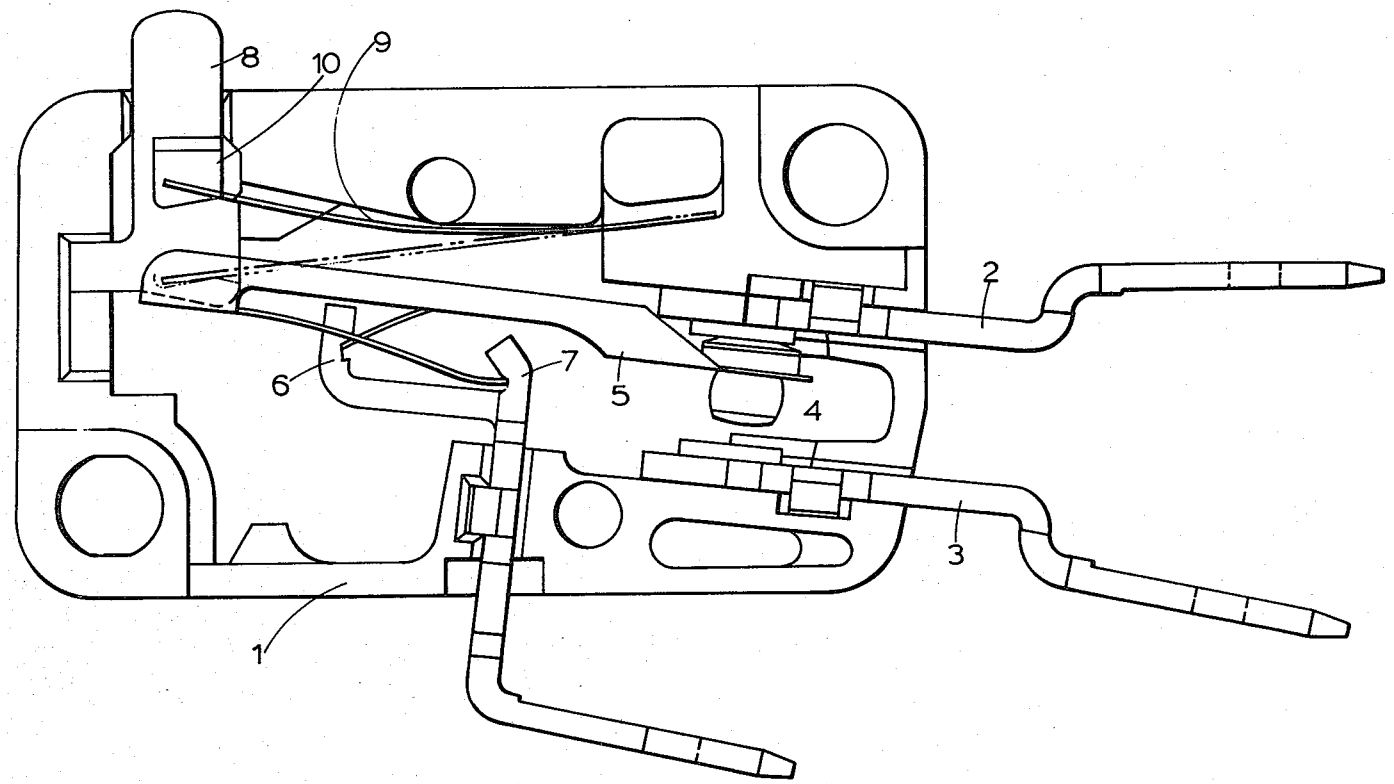
1
2
3
4
5
6
7
8
9
10

SNAP ACTION SWITCHES

BACKGROUND OF THE INVENTION

This invention relates to miniature snap action switches, often known as micro-switches. These generally require only a small force for operation but there is a requirement in certain fields for the operating force to be even lower than that which is normal at present.

This has previously been achieved by making the snap-action spring, which in one widely used design also forms the moving contact carrier, of a very thin material. The trouble with this is that, by weakening the carrier, one is also reducing the contact pressure, and also the pressures with which the limbs of the carrier engage in their locating abutments. This reduces the effective electrical rating of the switch, because of increased heating at these points, and the switch may also behave badly in conditions of vibration, since the contacts can be vibrated apart.

To reduce the operating force by increasing the leverage is no answer because the increased leverage means increased travel of the external actuating element.

BRIEF DESCRIPTION OF THE INVENTION

The aim of the invention is to provide a snap action switch with a very light actuating force without reducing the contact pressures. According to the invention this is achieved by an auxiliary spring which acts on the button or other actuating member in a direction to assist its actuating movement but in a manner such that it applies a load that falls with travel, i.e. it applies its maximum force to that member when the member is in its rest position and the force falls as the member is moved. Thus, when the member is in its rest position and the moving contact carrier is in one operative position, bearing against a fixed contact with adequate contact force, the auxiliary spring is applying a force only just insufficient to move the member against the force of the contact carrier, so that the additional externally applied force required to move it is very low. The contact force is unaffected by the auxiliary spring as the carrier is in its normal end position and is of normal strength. When the actuating member is moved, the opposing force applied to it by the auxiliary spring is arranged to fall, but the required actuating force is still light because, as the deadcentre position is approached, the opposing force of the contact carrier is also falling. Then once the deadcentre position is passed the opposing force is still low, but the force with which it engages the other fixed contact is as in existing switches.

The auxiliary spring is preferably a leaf spring with one end anchored against abutments in the casing of the switch and where the actuating member is a button the other end of the spring engages in a recess in the button.

Further objects, features and advantages of the invention will become apparent from a consideration of the following description, the appended claims and accompanying drawing in which:

BRIEF DESCRIPTION OF THE DRAWING

The drawing is an elevation view of a snap action switch in accordance with the principles of the present invention with one half of the casing removed.

DETAILED DESCRIPTION OF THE INVENTION

An example of a switch according to the invention is illustrated in the accompanying drawing, which shows the switch with one half of the casing removed. The switch is basically of known construction comprising a casing 1 with fixed contacts 2 and 3, one or the other of which is engaged by a moving contact 4 on spring-loaded contact carrier 5 in the form of a snap-acting over-centre spring engaging opposed abutments 6 and 7. The switch is actuated by a button 8 guided to slide in the casing. The auxiliary spring according to the invention is a leaf spring 9 with one end located in abutments formed by a recess moulded in the casing 1 and the other end engaging in a recess 10 in the button 8. The spring 9 bears down on the button (which is shown in its rest position), urging it in the operating direction. The strength of the spring is such that it very nearly, but not quite, overcomes the opposing force of the carrier 5. Its deflection is at a maximum, and so the force it applies falls when the button is actuated, becoming zero when it is in the position shown in broken lines.

While a preferred embodiment of the invention has been described herein, it is obvious that numerous omissions, changes and additions may be made in such embodiment without departing from the spirit and scope of the invention.

I claim:

1. A snap-action micro-switch comprising:

a casing having a plurality of mounting holes formed therein at preselected locations;

a fixed contact mounted within said casing;

an over-center snap action spring-loaded contact carrier mounting a movable contact and movable within said casing between a normal rest position occupied in the absence of an externally applied force and an operative position, said fixed contact being engaged by said movable contact in the rest position of said carrier;

an actuating button having first and second ends and guided for linear sliding movement within said casing;

said first end of said actuating button projecting outwards of said casing and said second end of said button engaging said carrier at a point displaced from said movable contact for movement of said carrier from said rest position to said operative position on inward sliding movement of said button in an actuating direction relative to said casing, said movement being effectable against the spring force of said spring-loaded carrier; and auxiliary spring means acting on said actuating button comprising a leaf spring located wholly within said casing and having first and second ends;

said first end of said spring being anchored in said casing and said second end of said leaf spring engaging said actuating button in the rest position thereof and being stressed such as to apply a force urging said button in said inward actuating direction but said force being insufficient to move said button unaided against the force of said spring-loaded carrier, and said applied force falling, though without changing direction on movement of said button in the actuating direction.

2. A switch as defined in claim 1 wherein said button has a lateral recess formed therein intermediate its ends and wherein said second end of said leaf spring engages within said recess.

* * * * *